US006723904B1

(12) United States Patent
Dolan et al.

(10) Patent No.: US 6,723,904 B1
(45) Date of Patent: Apr. 20, 2004

(54) AUTOMATED PLAYER FOR STRINGED INSTRUMENTS

(75) Inventors: Thomas Allen Dolan, Naples, FL (US); Don A. Gilmore, Kansas City, MO (US)

(73) Assignee: QRS Music Technologies, Inc., Naples, FL (US)

( * ) Notice: Subject to any disclaimer, the term of this patent is extended or adjusted under 35 U.S.C. 154(b) by 0 days.

(21) Appl. No.: 10/325,123

(22) Filed: Dec. 19, 2002

(51) Int. Cl.[7] ..... G10D 1/08
(52) U.S. Cl. ..... 84/267; 84/290
(58) Field of Search ..... 84/267, 290, 291, 84/294

(56) References Cited

U.S. PATENT DOCUMENTS 3,443,468 A * 5/1969 Kidwell
3,882,754 A * 5/1975 Godley et al.
4,037,503 A * 7/1977 Jacobson et al.
5,393,925 A * 2/1995 Wilson
5,760,321 A * 6/1998 Seabert ..... 84/312 R
6,166,307 A * 12/2000 Caulkins et al. ..... 84/50
6,191,350 B1 * 2/2001 Okulov et al. ..... 84/646

* cited by examiner

*Primary Examiner*—Kimberly Lockett
(74) *Attorney, Agent, or Firm*—Barnes & Thornburg

(57) ABSTRACT

An automated player for stringed instruments having a body portion including independent plucking and fretting mechanisms. The plucking mechanism includes a rotary plectrum assembly having a plurality of extendable quills positioned with its rotational axis parallel to a string of the instrument. The plectrum assembly is selectively rotatable by a first stepper motor and the quills are selectively extendable by an electric solenoid actuator, thus allowing for variable displacement of the string to produce vibration of variable intensity during operation. The fretting mechanism includes a carriage mounted to a belt and selectively driven by a second stepper motor along a track parallel to the instrument string. The carriage is in compressive contact with the string and thus may be selectively positioned at appropriate frets to shorten the vibrating length of the string. The player includes an embedded electronic circuit that controls the operation from programs installed or serially downloaded.

22 Claims, 9 Drawing Sheets

AUTOMATED PLAYER FOR STRINGED INSTRUMENTS

BACKGROUND OF THE INVENTION

The present invention relates to an automated player for playing stringed instruments. More specifically, it relates to an automated apparatus for playing unmodified, traditional stringed instruments such as the guitar.

Automated musical instruments have been in use for some time, and percussion instruments such as pianos, accordions, drums, marimbas, cymbals, etc., as well as wind instruments such as organs and calliopes have traditionally been the object of automation. For example, automated pianos known as player pianos have been in existence for well over a century. The use and operation of such player pianos are well known.

The automation of stringed instruments, conversely, has not been met with a great deal of success by manufacturers of automated instruments. Unlike the automation of percussion or wind instruments, many stringed instruments require more than a single action to result in a played note. Musicians play traditional stringed instruments, such as the guitar, by plucking or strumming the strings with one hand while pressing the individual strings against the neck or fingerboard of the instrument with the fingers of the other hand. When a string is depressed in such a manner, it bridges over raised metal ribs in the fingerboard or "frets," thus shortening the portion of that string available to vibrate after being plucked or strummed. A shorter vibrating portion results in a higher pitch for that string than occurs when the full length is allowed to vibrate, thus allowing many notes to be played on a single string.

Another method employed by musicians to manipulate the sounds produced by a stringed instrument includes stopping or "damping" the vibration of the strings before the natural dissipation of vibrating energy. Damping is accomplished by a variety of methods including using the side of the plucking or strumming hand, releasing or changing the fret position of depressed strings with the other hand, or lightly touching the strings with available fingers.

To accomplish this multi-action (plucking, fretting and damping) on stringed instruments, the prior art devices have required physical modification of the traditional instrument or large, unwieldy structures that are difficult to set up and effectively use. It is therefore an object of the present invention to provide an automated player having an automated plucking, fretting and damping means that is separate and independent from the instrument, but may easily be attached or mounted to an unmodified stringed instrument. It is a further object of the present invention to provide an automated player for stringed instruments that can pluck or strum the strings and selectively fret the strings and that includes an electronic circuit control system to produce music from pre-programmed or serially downloaded music programs. Furthermore, since the present invention operates without the need of a musician there are no human limitations, such as number of fingers, so music can be programmed and played that would be impossible for a human musician to perform.

SUMMARY OF THE INVENTION

An automated player for playing stringed instruments that may be easily mounted to an unmodified stringed instrument. The automated player includes a rectangular body having a first end and a second end. The first end is adapted to house one or more plucking mechanisms. The second end is adapted to house one or more fretting mechanisms.

The plucking mechanisms include a rotary plectrum assembly adapted to be placed with its rotational axis parallel to the axis of an instrument string and in intermittent mechanical communication with the instrument string. The rotary plectrum assembly includes a plurality of radially extending spokes, said spokes including radially extendable quills for displacing or plucking the instrument string as the plectrum assembly is rotated. The plucking mechanism includes a plectrum driver operable and in mechanical communication with the plectrum assembly to impart controlled rotational movement to the rotary plectrum assembly. The plucking mechanism further includes an actuator assembly having an actuator driver operable and in mechanical communication with the radially extendable quills for controllably adjusting the radial extension of the quills, thereby increasing or decreasing the amount of string displacement during a rotational pass of a quill, and hence the volume produced by the string.

The fretting mechanisms include a carriage assembly having a carriage and a carriage driver. The carriage is adapted to be in mechanical communication with the carriage driver and is positioned such that it is in compressive communication with a string of the instrument. The carriage driver is operable to provide controlled linear movement of the carriage along a suitable length of the instrument string.

The automated player includes an embedded electronic circuit to control the drivers and actuators from programs installed in random access memory or installed via a serial connection to a compatible computer or other MIDI device. The embedded electronic circuit, upon proper input from stored programs or serially downloaded programs, controls the mechanical operation of the plectrum driver, actuator driver and carriage driver to respectively rotate the rotary plectrum assembly, energize the actuator assembly and move the carriage to desired positions to produce the desired musical note.

These and other features of the present invention and the attendant advantages will be readily apparent to those having ordinary skill in the art and the invention will be more easily understood from the following detailed description of the preferred embodiment taken in conjunction with the accompanying drawings wherein like reference characters represent like parts throughout the several views.

BRIEF DESCRIPTION OF THE DRAWINGS

FIG. 10 is a simplified schematic of a carriage assembly according to the invention.

DETAILED DESCRIPTION OF THE PREFERRED EMBODIMENTS

Figure 1:
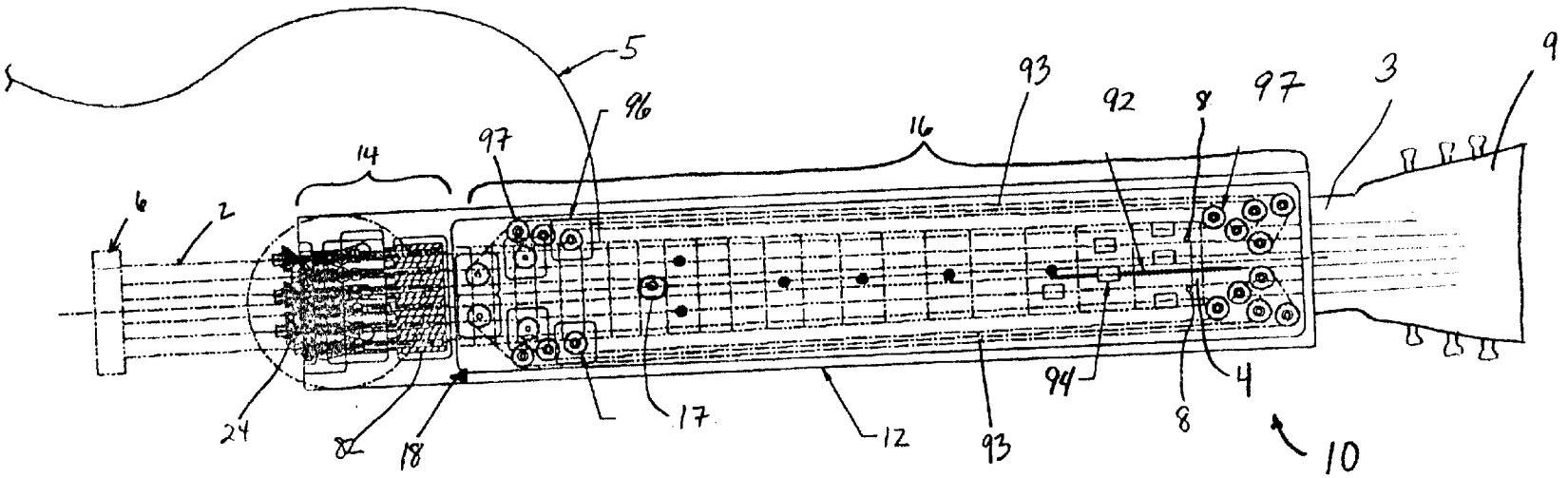
FIG. 1 shows an automated player according of the instant invention in mounted relationship to a guitar.

A presently preferred embodiment of the invention is described below with reference to the drawings. An automated player 10 of the present invention, as shown in FIG. 1, is adapted to be attached to the neck or fingerboard of a traditional stringed instrument, such as a guitar 5. Although the automated player 10 is shown in connection with an instrument with a neck, the player 10 could also be modified for use with a harp or other stringed instruments that do not have a neck. For ease of illustration, the invention is described with respect to the well-known six-string guitar 5 (FIG. 1) having a neck or fingerboard 3, strings 2, a head 9 and a bridge 6. However, one skilled in the art will appreciate that the present invention may be adapted to operate any stringed instrument that is played by plucking the strings.

Figure 4:
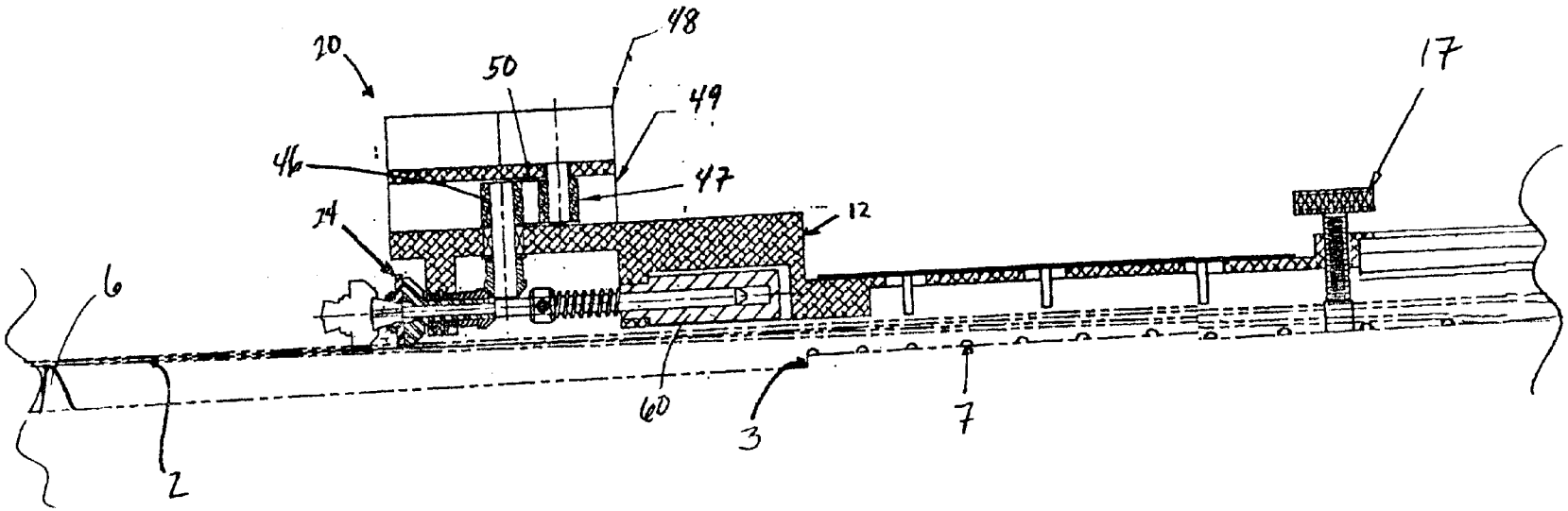
FIG. 4 is a partial cross sectional view of a plucking mechanism according to the invention.
Figure 5A:
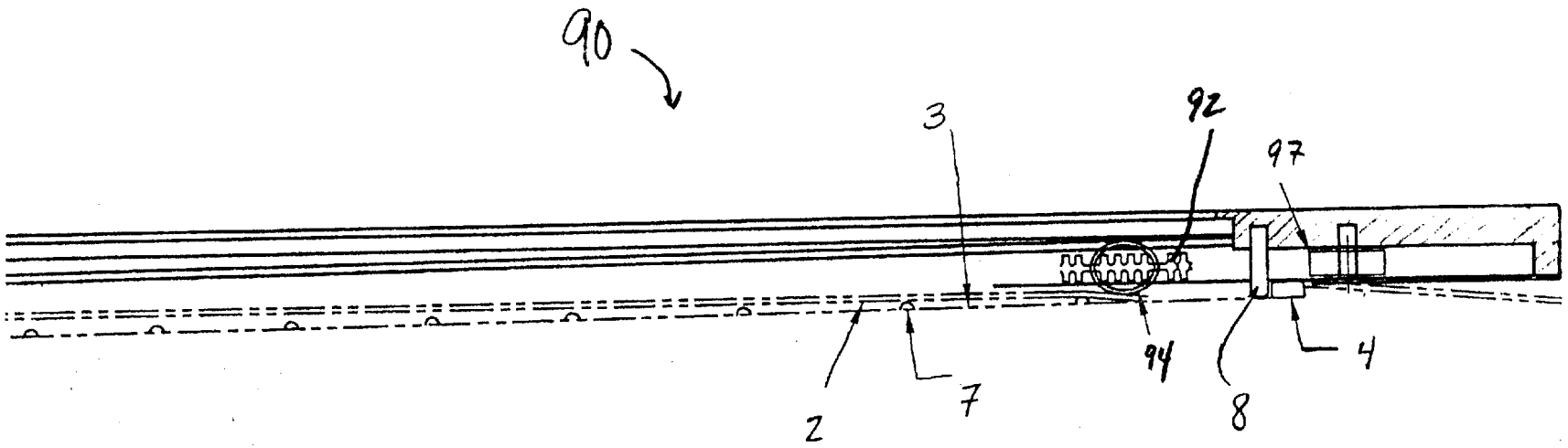
FIG. 5A is a partial cross sectional view of a fretting mechanism according to the invention.
Figure 5B:
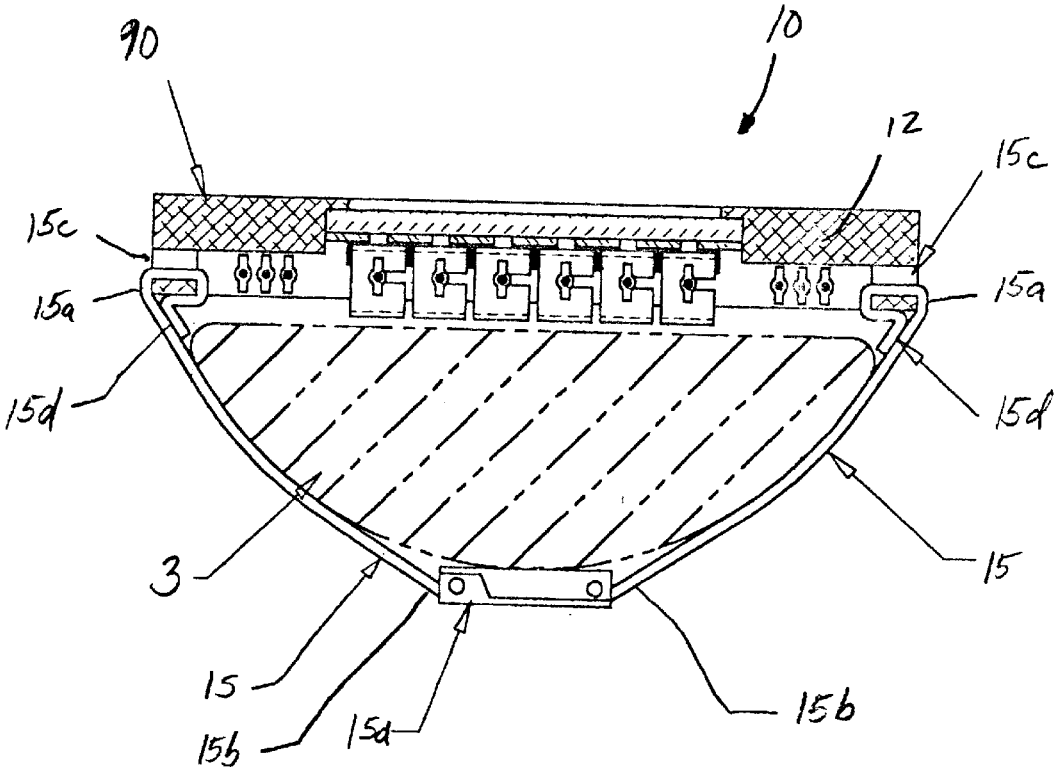
FIG. 5B is a cross sectional view of a fretting mechanism according to the invention depicted secured to the neck or fingerboard of a stringed instrument by securing straps and latch buckle.
Figure 8:
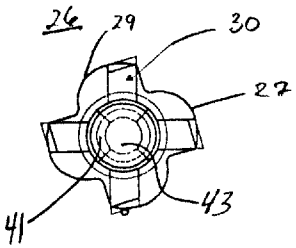
FIG. 8 is an end view of a rotary plectrum body.

The automated player 10 is placed on the front of the guitar aligning locating pins 8 with a nut 4 located at the upper end of a neck or fingerboard 3 (FIG. 5A). The locating pins 8 support the player 10 against the upper end of the neck or fingerboard while the player 10 includes a height adjustment thumbscrew 17 (FIGS. 2 and 4) to support the player against the lower end of neck 3 and allow for different height requirements of different instruments. Two sets of straps extending from the underside of the player 10 are wrapped around the neck of the guitar 5 and buckled or suitably secured. FIG. 5B shows straps 15 having a first end 15*a* and a second end 15*b*. The first ends 15*a* of straps 15 pass through strap slots 15*c* included in the player 10 and are secured in overlapping fashion with the rest of the strap 15 at point 15*d* by sewing or other suitable means of attachment. The second ends 15*b* of each strap are secured to each other by way of a draw latch buckle 15*d* or other suitable adjustable fastening means, such as by tying or use of hook and pile fasteners.

The player 10 preferably includes a rectangular body 12 constructed of aluminum or other suitable rigid material, such as plastic. The body 12 generally has a width slightly greater than the width of the neck or fingerboard of the instrument it is designed to play and preferably includes a glass or plexiglass window 18 such that the internal mechanisms may be viewed during operation of the player 10.

Figure 2:
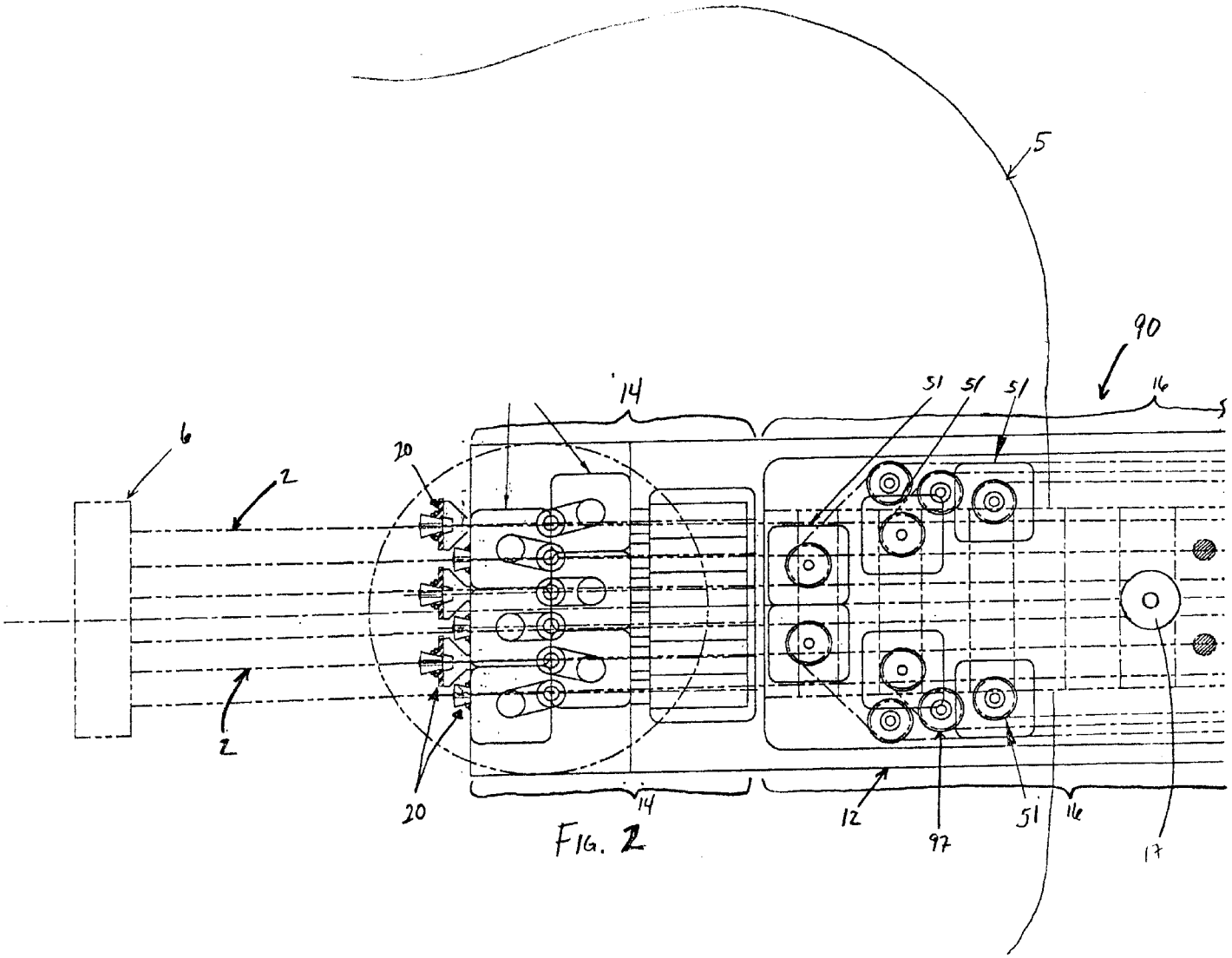
FIG. 2 is an enlarged partial view of the automated player of FIG. 1, depicting plucking mechanisms in mounted relationship to a guitar.

The body 12 includes a first end 14 and a second end 16. The first end 14 is adapted to house at least one plucking mechanism 20 in mechanical communication with a string 2. The number of plucking mechanisms employed in the player 10 is determined by the number of instrument strings to be plucked, with one plucking mechanism associated with each string 2. As best shown in FIG. 2 for the six-string guitar 5, six plucking mechanisms 20 are therefore employed and preferably staggered whereby each string 2 of the guitar 5 has a plucking mechanism 20 individually associated with it.

Figure 6:
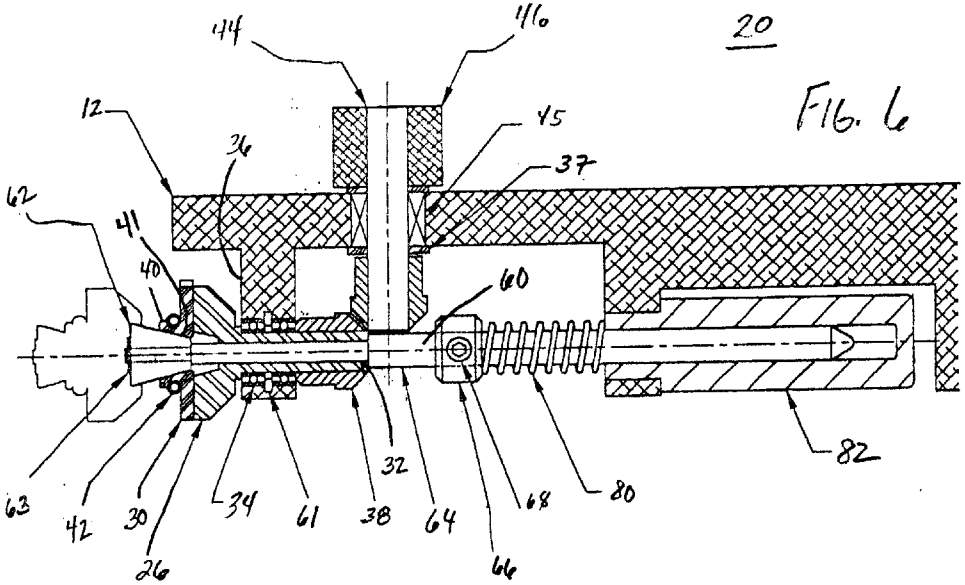
FIG. 6 is a cross sectional view of a plucking mechanism according to the invention.

Each plucking mechanism 20, as detailed in FIGS. 4 and 6, includes a rotary plectrum assembly 24 adapted to be placed in a string-contacting position relative to a string 2. The rotary plectrum assembly 24 is placed such that the rotational axis of the plectrum assembly 24 is parallel to the longitudinal axis of the string, and preferably directly above the string.

Figure 7:
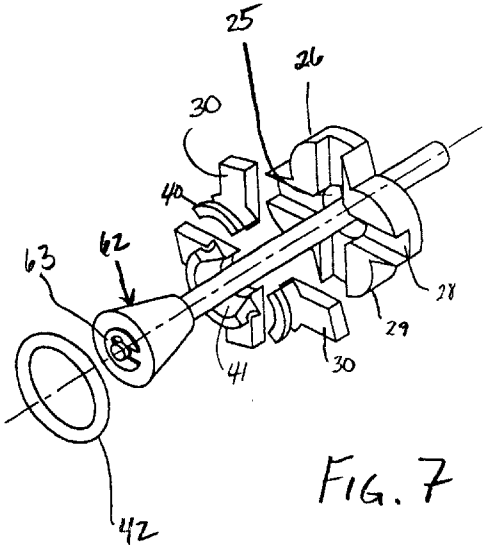
FIG. 7 is an exploded view of a rotary plectrum shown in relation to the actuator assembly.

The plectrum assembly, shown in FIG. 7 in greater detail, includes a plectrum body 26 having four spokes 27 extending radially with respect to a central bore 25. Each spoke 27 includes a rounded damping edge 29 and a quill slot 28 for receiving a radially extendable quill 30. The quills 30 include a lip 40 for receiving a garter spring 42 to retain the quills 30 in place. The quills are constructed so that they extend slightly further than the spokes 27 along the circumference of the plectrum body 26. When placed in the quill slots 28 and retained by the garter spring 42, the quills 30 define a central hole 43 coaxial with the central bore 25 and the lips 40 form a conical recess 41 adapted to receive a tapered cam 62.

The plectrum body 26 further includes a hollow plectrum shaft 32 (See FIG. 6) extending from the spokes 27 through duplex ball bearings 34 mounted in a protruding flange 36 of the body 12. A first miter bevel gear 38 is mounted on the plectrum shaft 32 and adapted to be in mechanical communication with a second miter bevel gear 39 placed at a right angle to the first gear 38. The second gear 39 is mounted to a steel shaft 44 that passes through a nylon thrust washer 37 and a needle bearing 45 mounted in the body 12. A first timing pulley 46 is mounted on the steel shaft 44 opposite the second gear 39. The first timing pulley 46 is adapted to be driven by a timing belt 50 (See FIG. 4) in driving communication with a second timing pulley 47 engaged by a first stepper motor 48 mounted to the body 12 on a motor bracket 49.

The plucking mechanism 20 further includes an actuator assembly 60 (See FIG. 6) including a tapered cam 62, an actuator shaft 64, a stop collar 66, a compression spring 80 and a solenoid actuator 82. The solenoid actuator 82 is operably coupled to the actuator shaft 64. The actuator shaft extends through the compression spring 80, the hollow plectrum shaft 32 and conical recess 41. The tapered cam 62 is attached to the actuator shaft 64 and retained in place with an E-type snap ring 63. The tapered cam 62 is adapted to be received by the conical recess 41 formed by the quills 30 of the rotary plectrum assembly 24. The compression spring 80 holds the actuator shaft in its fully extended position. The stop collar 66 includes a setscrew 68 that allows for adjustment of the actuator shaft's 64 range of motion relative to the compression spring 80.

Figure 3:
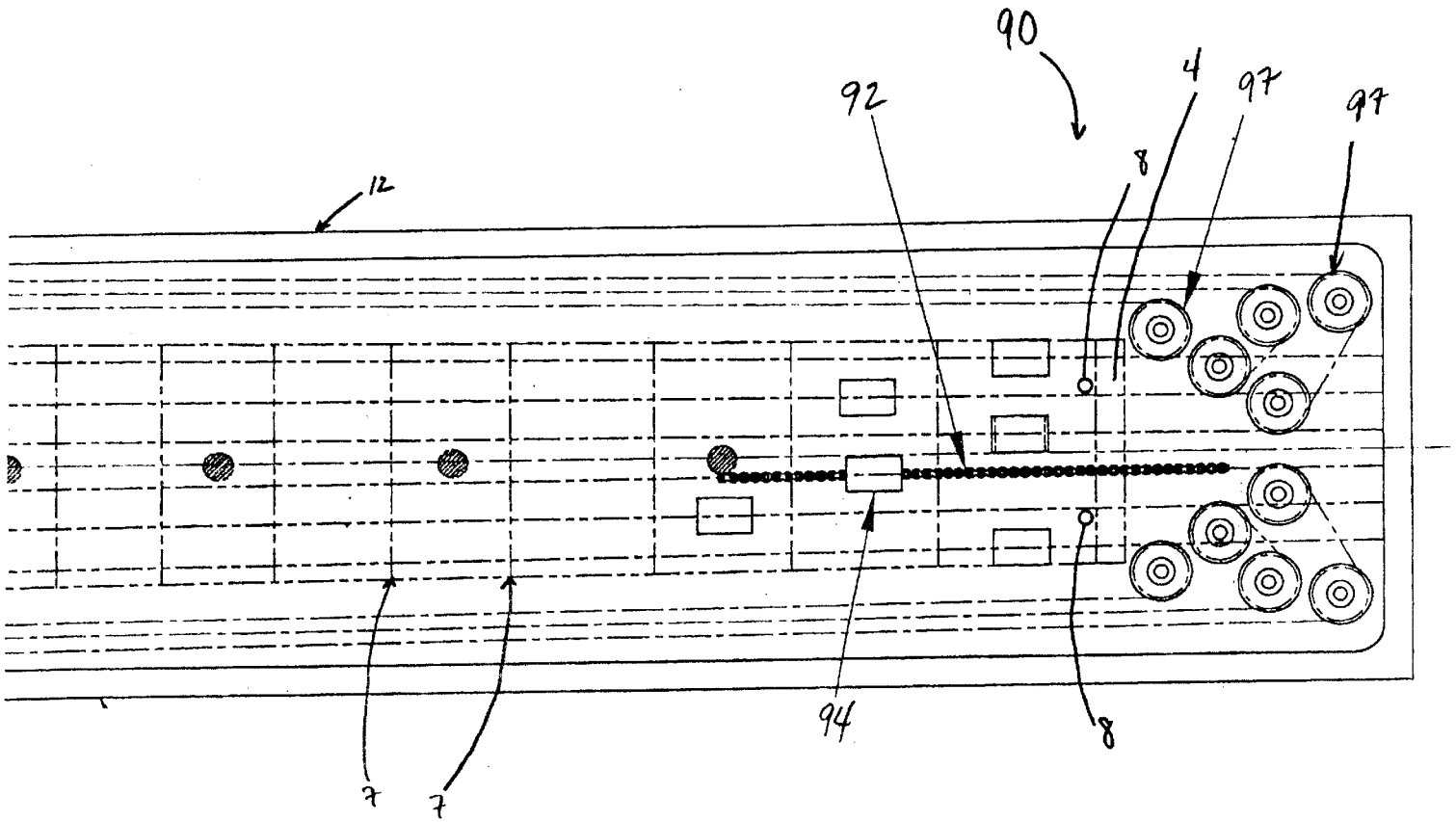
FIG. 3 is an enlarged view of the automated player of FIG. 1, depicting the fretting mechanisms of the player as preferred for a six-string instrument, such as a guitar.

The second end 16 of the body 12 is adapted to house at least one fretting mechanism 90. The number of fretting mechanisms 90 employed is determined again by the number of instrument strings and generally one fretting mechanism 90 is associated with each string 2 of the instrument to be fretted. As best shown in FIGS. 3, 5 and 10, each fretting mechanism 90 includes a carriage 94 comprising a segment of plastic tubing, preferably Teflon. When the player 10 is mounted to the guitar, the carriage 94 comes in contact with a string 2 and is partially compressed. The natural elasticity of the Teflon or plastic carriage 94 causes the carriage 94 to resist this compression, and thus, the carriage 94 depresses the string 2 against the fingerboard 3. This elasticity also allows the carriage 94 to further compress and pass over the frets 7 easily and quietly during operation. The use of a Teflon tube segment also provides the carriage 94 with a wide contact area for contacting a string 2, thus allowing an individual player 10 to be used with instruments having widely varying string spacing. Additionally, the low coefficient of friction of the carriage, preferably polytetrafluoroethylene, means quiet movement during operation and that no permanent abrasive damage is caused to the guitar 5.

The carriage 94 includes belt slots 98 that allow the carriage 94 to be attached to a carriage belt 92. The carriage belt 92, preferably a Flex-E-Belt® manufactured by W. M. Berg, Inc., is generally continuous and is driven by a second stepper motor 51 (FIG. 2) positioned near the first end 14. One or more idler pulleys 97 (FIG. 3) adapted to roll freely are mounted on dowel pins fixed to the body 12. The idler pulleys 97 allow the carriage belt's 92 direction of travel to be manipulated to circumvent other fretting mechanisms and align with a desired string 2, as well as direct the belt 92 through an area adapted for a belt return 93. The Flex-E-Belt®, which consists of individual plastic, preferably polyurethane, links molded on a steel cable, allows the carriage belt to flex and therefore resist binding that a conventional steel chain would encounter during non-parallel travel as described below.

Figure 9:
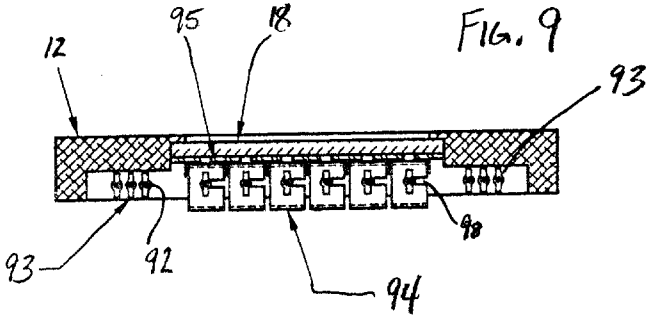
FIG. 9 is a partial cross sectional view of the fretting mechanism taken along a line perpendicular to the instrument strings.
Figure 16:
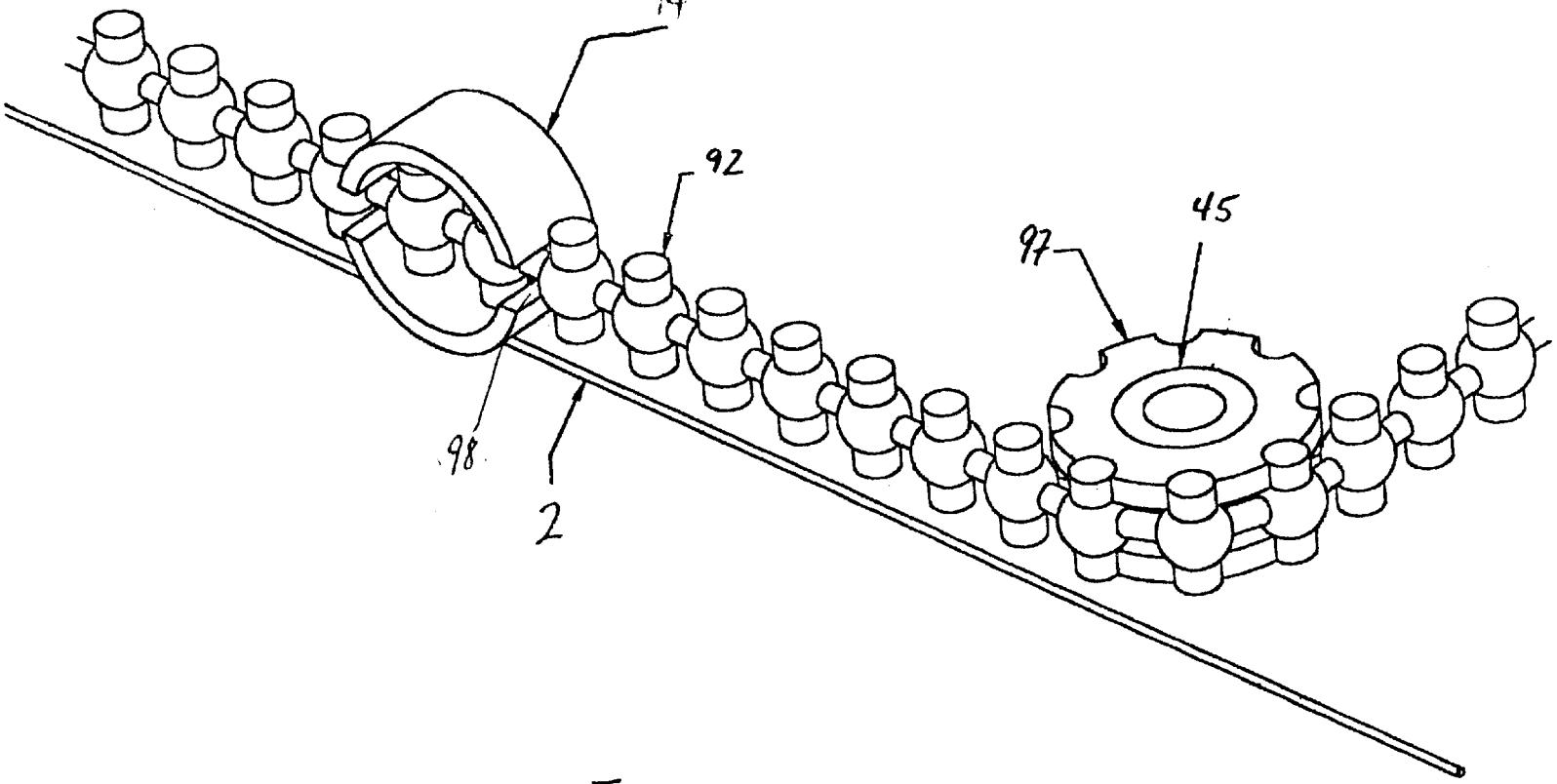

The carriage 94 slides in a guide channel or track 95 (FIG. 9) formed in the body 12 or constructed of suitable material and attached to the body 12, such as metal tracks attached to the underside of the plexiglass window 18. The track 95 maintains the carriage 94 in direct and linear contact with the string 2 as the carriage 94 is driven by the belt 92. Since the strings 2 of a guitar are not strung parallel to the fingerboard but incline toward the bridge 6 (see FIG. 4), the track's 95 depth is progressively reduced as it nears the body of the guitar 5 so the carriage 94 travels in a line parallel with the fingerboard 3 while the rest of the player 10 is parallel to the string 2. Such a correction for the unparallel relationship between the fingerboard 3 and string 2 provides for sufficient compressive force by the carriage 94 to fret the string 2 over frets 7 closer to the body of the guitar 5 while still easily traveling over frets 7 located farther up the fingerboard 3. While it would be possible to adapt the player 10 such that the carriage 94 may be positioned past the nut 4 for open string notes, due to the excessive compression of the carriage 94 required to do so, preferably the user is instructed to manually de-tune the instrument a musical half step (one fret) downward. Then, when the carriage 94 is next to the nut 4 (FIG. 5A) (at the first fret) the player 10 will generate a note equivalent to the normal, open-stringed value.

Figure 11:
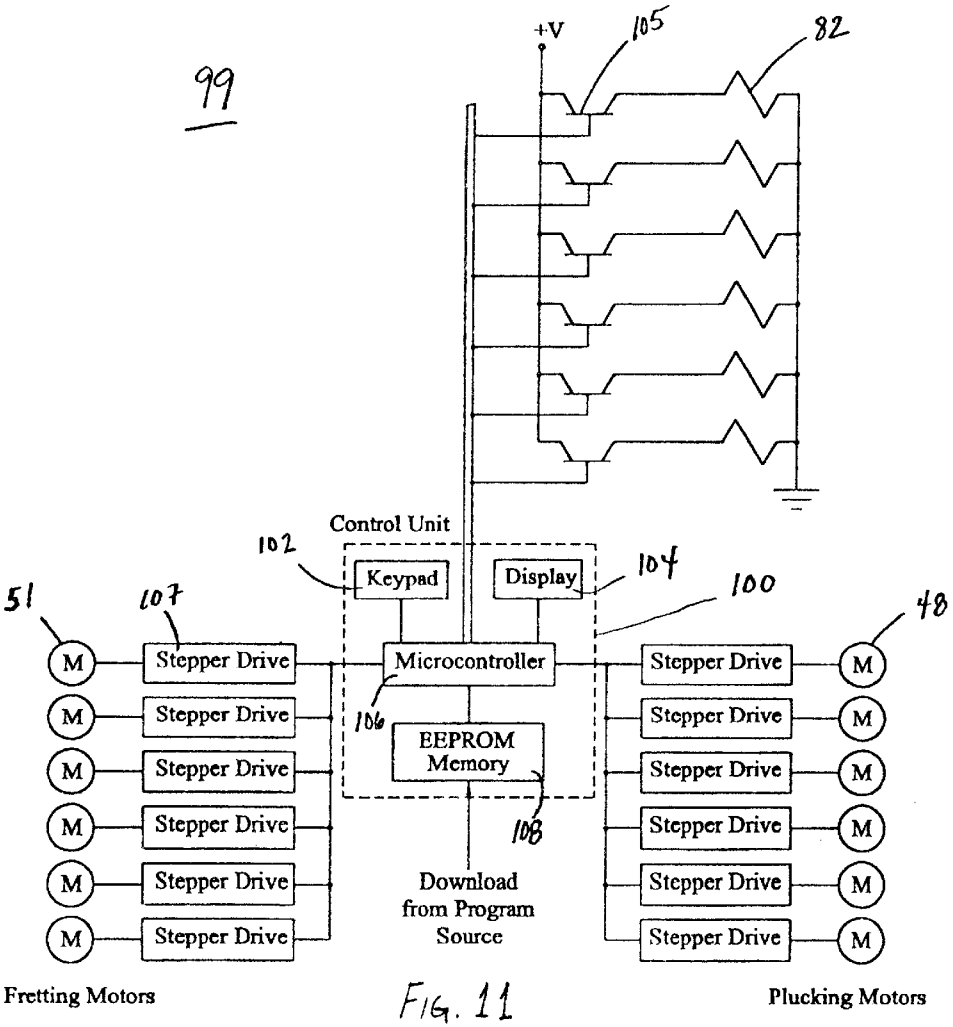
FIG. 11 is an electronic circuit for the components of the present invention as applied to a player adapted for playing a six-string instrument, such as a guitar.

The body 12 includes an embedded electronic control circuit 99 (not show) in communication with each stepper motor 48 and 51 or solenoid actuator 82 such that they operate independently of each other and are operable in sequence to produce pre-programmed music. FIG. 11 depicts a block diagram of the embedded electronic control circuit 99 of the present invention for a six-string player 10 as shown in FIGS. 1 and 2. The control unit 100 includes a keypad 102, a display 104, a microcontroller 106 and a EEPROM memory 108. Instructions may be stored in random access memory or downloaded via a serial connection that may be connected to a computer or other MIDI device. The microcontroller 106 processes the instructions stored in memory or downloaded via a serial connection and outputs a signal to each stepper drive 107 associated with a stepper motor 48 and 51 and a power transistor 105 associated with a solenoid actuator 82. These signals control the movement of the stepper motors 48 and 51 and solenoid actuators 82, respectively. The activation of the motors 48 and 51 and solenoids 82 produce the desired mechanical action on the strings 2 to produced the desired sounds. All programming would take into account any manual de-tuning required for open note playing.

In operation, the plectrum body 26 is initially positioned against the string 2 such that a spoke 27 is contacting the string 2. Upon a proper signal communicated from the microcontroller 106, the stepper motor 48 exerts a driving force that is transferred through the timing belt 50, timing pulley 46, steel shaft 44 and first and second miter bevel gears 38 and 39 to rotate the plucking assembly about an axis parallel to the string to be plucked. As the plectrum assembly 24 is indexed 45 degrees rotationally, the string 2 is plucked by the passing quills 30 and the plucked string 2 vibrates freely. If the plectrum assembly is indexed another 45 degrees, the rounded damping edge 29 of the next spoke 27 comes into contact with the string 2 and it is damped and ready to be plucked again by a 45 degree indexing of the plectrum assembly 24.

The present invention advantageously allows for varying the volume generated by the plucking of the string 2. When a signal is communicated from the microcontroller 106 to the solenoid actuator 82, the solenoid actuator 82 generates a pulling force on the actuator shaft 64 and compresses the compression spring 80. The tapered cam 62 is pulled into the conical recess 41 and the quills 30 are forced radially outward to protrude farther from the plectrum body 26. As the plectrum assembly 24 is indexed pass the string 2, the now farther protruding quills 30 exert a greater displacing or plucking force on the string 2. The greater plucking force results in greater vibration and thus greater volume. The amount of protrusion (and thus the volume produced) can be controlled by varying the amount of voltage applied to the solenoid actuator 82.

From the foregoing description of a preferred embodiment, one skilled in the art will appreciate that various modifications and variations can be made in the structure of the automated player 10. For example, while the preferred embodiment was described with regard to use of stepper motors and solenoid actuators, one skilled in the art may substitute other means known in the art for imparting the forces required to rotate the plectrum assembly 24, extend the quills 30 or drive the carriage belt 92. Furthermore, one skilled in the art will appreciate that the player may be adapted for instruments with any number of strings or other physical shapes different from the guitar as shown. Thus, it will appear to those skilled in the art that various modifications and variations can be made in the structure of the automated player 10 of the present invention without departing from the scope or spirit of the invention. It is intended that the present invention cover the modifications and variations of the invention provided they come within the scope of the appended claims and their equivalents.

What is claimed is:

1. An automated player for playing an unmodified stringed instrument comprising:

at least one plucking mechanism operable to selectively and releaseably contact and displace a corresponding instrument string such that the instrument string vibrates and produces a sound, and wherein said plucking mechanism further comprises (i) a string-contacting portion rotationally mounted relative to the corresponding string and having a rotational axis substantially parallel to the corresponding instrument string, said string-contacting portion including at least one extendable quill, (ii) a first drive member in mechanical communication with said string-contacting portion and capable of creating relative movement between the first drive member and the string-contacting portion, (iii) an actuator in mechanical communication with said at least one extendable quill, said actuator operably engaging said at least one quill whereby to create relative movement between said actuator and said at least one quill, whereby said at least one quill is selectively extendable to vary the displacement of said string during a rotation of said string-contacting portion.

2. The automated player of claim 1, wherein the string-contacting portion comprises a plurality of spokes, said spokes each housing a quill and being defined by a first edge and a second edge, at least one of said first or second edge being substantially rounded; whereby, the substantially rounded edge may be selectively brought into contact with the instrument string to variably damp vibrations.

3. The automated player of claim 2, wherein the player further comprises an electronic circuit control, said circuit control in electrical communication with said actuator and said first drive member, said circuit control operable to selectively output signals to the first drive member and the actuator to operate said plucking mechanism.

4. The automated player of claim 1 further comprising at least one fretting mechanism operable to selectively depress the corresponding instrument string such that the vibration of the instrument string occurs over a desired string length, said fretting mechanism comprising:

(i) a carriage operable to be placed in depressive contact with the instrument string; and, (ii) a second drive member in mechanical communication with the carriage and capable of creating relative movement between the second drive member and the carriage, said second drive member operable to selectively position the carriage.

5. The automated player of claim 4, wherein the string-contacting portion comprises a plurality of spokes, said spokes each housing a quill and being defined by a first edge and a second edge, at least one of said first or second edges being substantially rounded; whereby, the substantially rounded edge may be selectively brought into contact with the instrument string to variably damp vibrations.

6. The automated player of claim 4, wherein the carriage comprises a segment of plastic tubing.

7. The automated player of claim 4 wherein the carriage is attached to a carriage belt in mechanical communication with the second drive member.

8. The automated player of claim 7, wherein the carriage belt comprises individual plastic links molded to a cable.

9. The automated player of claim 6, wherein the segment of plastic tubing comprises polytetrafluoroethylene.

10. The automated player of claim 5, wherein the player further comprises an electronic circuit control, said circuit control in electrical communication with said actuator and said first and second drive members, said circuit control operable to selectively output signals to the first and second drive members and the actuator to operate said plucking and said fretting mechanisms.

11. The automated player of claim 10, wherein the first and the second drive members comprise stepper motors, and the actuator comprises an electric solenoid.

12. An automated player for playing an unmodified stringed instrument comprising:

(A) at least one plucking mechanism operable to selectively and releaseably contact and displace a corresponding instrument string such that the instrument string vibrates and produces a sound, and wherein said plucking mechanism further comprises (i) a string-contacting portion rotationally mounted relative to the corresponding string and having a rotational axis substantially parallel to the corresponding instrument string, said string-contacting portion including at least one extendable quill, (ii) a first drive member in mechanical communication with said string-contacting portion and capable of creating relative movement between the first drive member and the string-contacting portion, (iii) an actuator in mechanical communication with said at least one extendable quill, said actuator operably engaging at least one quill such that there is relative movement between the actuator and the quill, whereby said at least one quill is selectively extendable to vary the displacement of said string during a rotation of said string-contacting portion; and, (B) at least one fretting mechanism operable to selectively depress the corresponding instrument string such that the vibration of the instrument string occurs over a desired string length, said fretting mechanism comprising:

(i) a carriage operable to be placed in depressive contact with the instrument string; and, (ii) a second drive member in mechanical communication with the carriage and capable of creating relative movement between the second drive member and the carriage, said second drive member operable to selectively position the carriage.

13. The automated player of claim 12, wherein said string-contacting portion comprises a wheel having four spokes extending radially with respect to a central bore, each of said spokes including a quill slot adapted to receive an extendable quill.

14. The automated player of claim 13, wherein said four spokes include a first edge and a second edge, at least one of said first and second edges being substantially rounded, whereby the substantially rounded edge may be selectively brought into contact with the instrument string to variably damp vibrations.

15. The automated player of claim 12, wherein said carriage comprises a segment of plastic tubing.

16. The automated player of claim 13, wherein said carriage is engaged by a carriage belt in mechanical communication with said second drive member.

17. The automated player of claim 16, wherein said carriage belt comprises a flexible belt constructed of individual plastic links affixed to a cable.

18. The automated player of claim 17, wherein said carriage comprises polytetrafluoroethylene.

19. The automated player of claim 18, wherein the player further comprises an embedded electronic circuit control, said circuit control in electrical communication with said actuator and said first and second drive members, said circuit control operable to selectively output signals to the first and second drive members and the actuator to operate said plucking and fretting mechanisms.

20. An automated player for playing an unmodified stringed instrument comprising:

(A) at least one plucking mechanism operable to selectively and releaseably contact and displace a corresponding instrument string such that the instrument string vibrates and produces a sound, and wherein said plucking mechanism further comprises (i) a string-contacting portion rotationally mounted relative to the corresponding string and having a rotational axis substantially parallel to the longitudinal axis of the corresponding instrument string, said string-contacting portion comprising four spokes extending radially with respect to a central bore, each of said spokes including a quill slot adapted for receiving an extendable quill, said spokes further including a first edge having a substantially rounded periphery, whereby said first edge is operable to be selectively brought into contact with said string to variably damp string vibrations, (ii) a first drive member in mechanical communication with said string-contacting portion and capable of creating relative movement between the first drive member and the string-contacting portion, said first drive member comprising a first stepper motor, (iii) an actuator in mechanical communication with said extendable quills, said actuator operably engaging said quills such that there is relative movement between the actuator and the quills, said actuator including a shaft coupled to a solenoid, said shaft having a tapered end adapted to engage said extendable quills, whereby said solenoid is energized to selectively extend said quills to vary displacement of said string during a rotation of said string-contacting portion; and, (B) at least one fretting mechanism operable to selectively depress the corresponding instrument string such that the vibration of the instrument string occurs over a desired string length, said fretting mechanism comprising:

(i) a carriage comprising a segment of tubing mounted to a flexible belt and adapted to be placed in depressive contact with the instrument string; and, (ii) a second drive member in mechanical communication with the flexible belt and capable of creating relative movement between the second drive member and the carriage, said second drive member comprising a second stepper motor operable to selectively position the carriage.

21. The automated player of claim 20, wherein the player is a separate construction operable for detachably mounting to an unmodified guitar.

22. A method for electronically playing a musical instrument having a plurality of strings and a plurality of frets extending transverse to the strings, said method comprising:

a) selectively rotating at least one of a plurality of first members, each first member being associated with one of the plurality of strings of said musical instrument and each adapted to rotate about a rotational axis substantially parallel to the associated string, each first member having an electrically operated driver which when energized rotates the associated first member, each first member having a string contacting member extending radially outwardly from the rotational axis of said first member a sufficient distance to contact and effect plucking of the associated string when said first member is rotated;

b) selectively moving at least one of a plurality of string depressing second members substantially parallel to the string, each of said string depressing members being associated with one of the plurality of strings of said musical instrument and each second member having an electrically operated second driver adapted to move the associated second member to a position above one of the frets of the musical instrument and adapted to press the associated string into contact with said one fret in time with the rotation of the first member associated with that string; and, c) electronically energizing said first and second drivers to effect plucking and fretting of the strings of said musical instrument in a predetermined time sequence to effect playing of the instrument.

* * * * *